US005323746A

United States Patent [19]

Best et al.

[11] Patent Number: 5,323,746

[45] Date of Patent: Jun. 28, 1994

[54] GOVERNOR

[75] Inventors: Christopher H. Best; David Shufflebotham, both of Kent, England

[73] Assignee: Lucas Industries, England

[21] Appl. No.: 865,705

[22] Filed: Apr. 8, 1992

Related U.S. Application Data

[63] Continuation of Ser. No. 624,058, Dec. 7, 1990, abandoned.

[30] Foreign Application Priority Data

Dec. 19, 1989 [GB] United Kingdom ..... 8928597

[51] Int. Cl.[5] ..... F02M 37/04

[52] U.S. Cl. ..... 123/357; 123/361

[58] Field of Search ..... 123/357, 358, 359, 361

[56] References Cited

U.S. PATENT DOCUMENTS

| | | | |
|---|---|---|---|
| 3,939,738 | 2/1976 | Adey | 123/357 |
| 4,416,232 | 11/1983 | Shiozaki | 123/357 |
| 4,453,516 | 6/1984 | Filsinger | 123/357 |
| 4,502,438 | 3/1985 | Yasuhara | 123/357 |
| 4,541,392 | 9/1985 | Ogino | 123/357 |
| 4,548,177 | 10/1985 | Best | 123/357 |
| 4,834,045 | 5/1989 | Imai | 123/361 |
| 4,917,063 | 4/1990 | Hiraki | 123/357 |

FOREIGN PATENT DOCUMENTS

| | | | |
|---|---|---|---|
| 0012026 | 2/1981 | Japan | 123/357 |
| 58-2430 | 1/1983 | Japan . | |
| 58-2433 | 1/1983 | Japan . | |
| 59-25039 | 2/1984 | Japan | 123/357 |
| 0180046 | 10/1984 | Japan | 123/357 |
| 2021291 | 11/1979 | United Kingdom . | |

*Primary Examiner*—Carl S. Miller

*Attorney, Agent, or Firm*—Andrus, Sceales, Starke & Sawall

[57] ABSTRACT

A governor system for the fuel pump of an engine which drives a vehicle through a multi ratio gearbox includes an all speed governor. The governor characteristic in the intermediate speed range is modified by means responsive to the load on the vehicle and by means responsive to the transmission ratio of the gearbox.

1 Claim, 2 Drawing Sheets

GOVERNOR

This is a continuation of application Ser. No. 07/624,058, filed Dec. 7, 1990, now abandoned.

This invention relates to a governor system for the fuel pump of an internal combustion engine which in use powers a road vehicle. For a road vehicle used for transporting goods for example an articulated vehicle, it is the usual practice to provide a so-called all-speed governor system since the characteristic provided by such a system is ideal for use when the vehicle is in a loaded state. In such a system the driver of the vehicle sets the required engine speed and the governor system within the power capability of the engine and any other restraints such as engine exhaust smoke level, adjusts the fuel supply to the engine so as to attain and maintain the required speed.

The governor system will respond very quickly to changes in the required speed but the response of the vehicle will be much slower because of its loaded state.

An alternative form of governor system is known as the two-speed system in which the governor system controls the maximum speed and the idling speed of the engine. The intermediate speeds are controlled by the vehicle driver since in this system, in the intermediate speed range adjustment of the throttle pedal adjusts directly the amount of fuel supplied to the engine. Such a system facilitates the control of the vehicle when it is in an unloaded state but since vehicles are in most cases loaded to their maximum extent the usual practice is to provide an all-speed governor system.

If the vehicle is in an unloaded state for example if in the case of an articulated vehicle the tractor unit is uncoupled from the trailer, the vehicle becomes more difficult to control since if the required speed is increased, the governor system will react to increase the fuel supply to the engine to its maximum allowed level and will only start to reduce the level of fuel supply as the new required speed is attained. Similarly if the required speed is reduced the governor system will react to reduce the level of fuel supply to a low value and will only increase the level of fuel supply as the new required speed is attained. In its unladen state therefore the vehicle is difficult to control.

GB 2069187B proposes a partial solution to the above problem by providing a sensor which is responsive to the loaded state of the vehicle. The signal from the sensor is utilised to modify the governor characteristic. This solution is not entirely satisfactory and the object of the present invention is to provide a governor system in an improved form.

According to the invention a governor system for the fuel pump of an internal combustion engine which drives a road vehicle through a variable ratio transmission, includes a governor having an all-speed characteristic and includes first means responsive to the loaded state of the vehicle and second means responsive to the transmission ratio of the transmission, said first and second means acting to modify the response of the governor in the intermediate speed range.

An example of a governor system in accordance with the invention will now be described with reference to the accompanying drawings in which.

Figure 1:
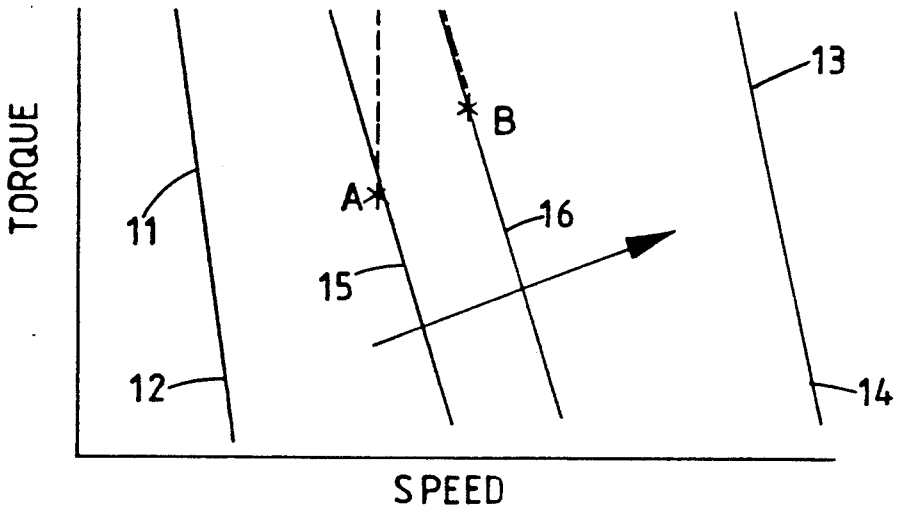
FIG. 1 shows the governor characteristic of an all-speed governor.

Referring to FIG. 1 of the drawings there is shown the characteristic of an all-speed governor with engine torque being plotted against engine speed. The line 10 represents the maximum fuel line which during normal operation of the engine cannot be exceeded. The line 11 represents the idle pull-off curve, the normal idling speed of the engine being that corresponding to the point 12. The line 13 represents the maximum speed pull-off curve, the point 14 corresponding to the maximum permitted engine speed. The lines 15 and 16 lying between the lines 12 and 13 represent different levels of demanded engine speed, the line 16 as indicated by the arrow, representing a higher demand than the line 15.

Suppose for example that the engine is operating at point A in equilibrium that is to say just sufficient fuel is being supplied to the engine to provide sufficient torque to maintain the steady speed of the engine. In the event that the operator of the vehicle increases the demand to attain an increased speed represented by the point B, the torque provided by the engine will increase in more or less a step wise manner to the point C. This is because in response to the increased demand, the governor system will move the fuel control member of the fuel pump to a position to provide the maximum fuel. With the increased torque available the engine speed will increase to the point D and in the particular example, there will be a slight increase in the amount of fuel supplied to the engine. As soon as point D is reached whilst there will be an increase in engine speed, the torque developed by the engine will in fact reduce this being occasioned by movement of the control member of the fuel pump to reduce the amount of fuel supplied to the engine. Point B represents a new equilibrium position which is established at the new desired speed with the engine torque increased to maintain that speed. It will be noted from FIG. 1 that there is a substantial increase in the torque delivered by the engine and this increase in torque results in an increase in torque at the driving wheels of the vehicle. The actual torque available at the driving wheels of the vehicle depends upon the gear ratio of the transmission of the vehicle and as a gear is selected which results in a higher engine speed for a given road-speed of the vehicle there will be an increase in the torque multiplication. It is therefore more difficult to control the vehicle as the gear ratio is changed in the direction to increase the engine speed for a given road speed. The effect is made worse if the vehicle is unladen. It is therefore proposed to modify the governor characteristics in accordance with the gear ratio selected and in accordance with the state of load of the vehicle.

Figure 2:
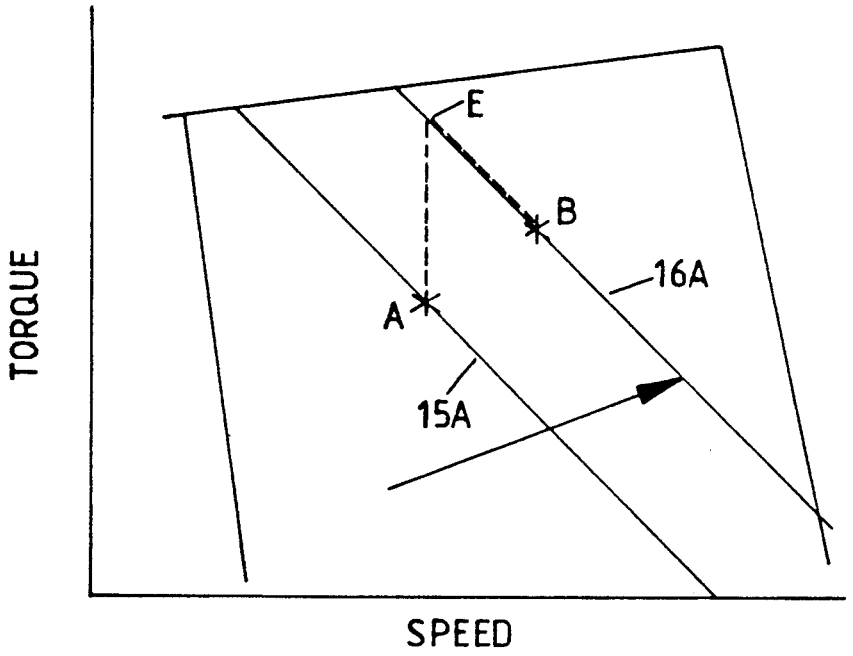
FIG. 2 shows the governor characteristic of an all-speed governor as modified in accordance with the invention.

FIG. 2 shows modified governor characteristics which show the lines 15A and 16A having a greater reverse slope. Starting at the point A on line 15A when the driver requires to increase the speed to that corresponding to point B, depression of the throttle pedal will result in an increase in the amount of fuel supplied to the engine but the actual increase will be limited to that which corresponds to point E lying on the line 16A. The increase in engine torque is therefore substantially less than that which is shown in FIG. 1 and the greater the reverse slope, the smaller the increase in torque which occurs. Thus the increase in torque at the driving wheels of the vehicle is reduced and this facilitates control of the vehicle.

The value of the reverse slope is ideally chosen such that a constant vehicle acceleration results from a uniform increase in demand, this being a direct function of available tractive effort and an inverse function of the vehicle mass according to Newtons first law. In practice the system is likely to limit acceleration to acceptable levels in operating regions where low gear ratios and/or low vehicle weight exist with full available engine power being transmitted where this does not inhibit vehicle control or ride comfort. Ideally a progressive load sensor is used for the derivation of vehicle weight but again this can be comprised practically by sensors which give an indication of the loaded state of the vehicle or even by switch inputs under the control of the vehicle driver.

Figure 3:
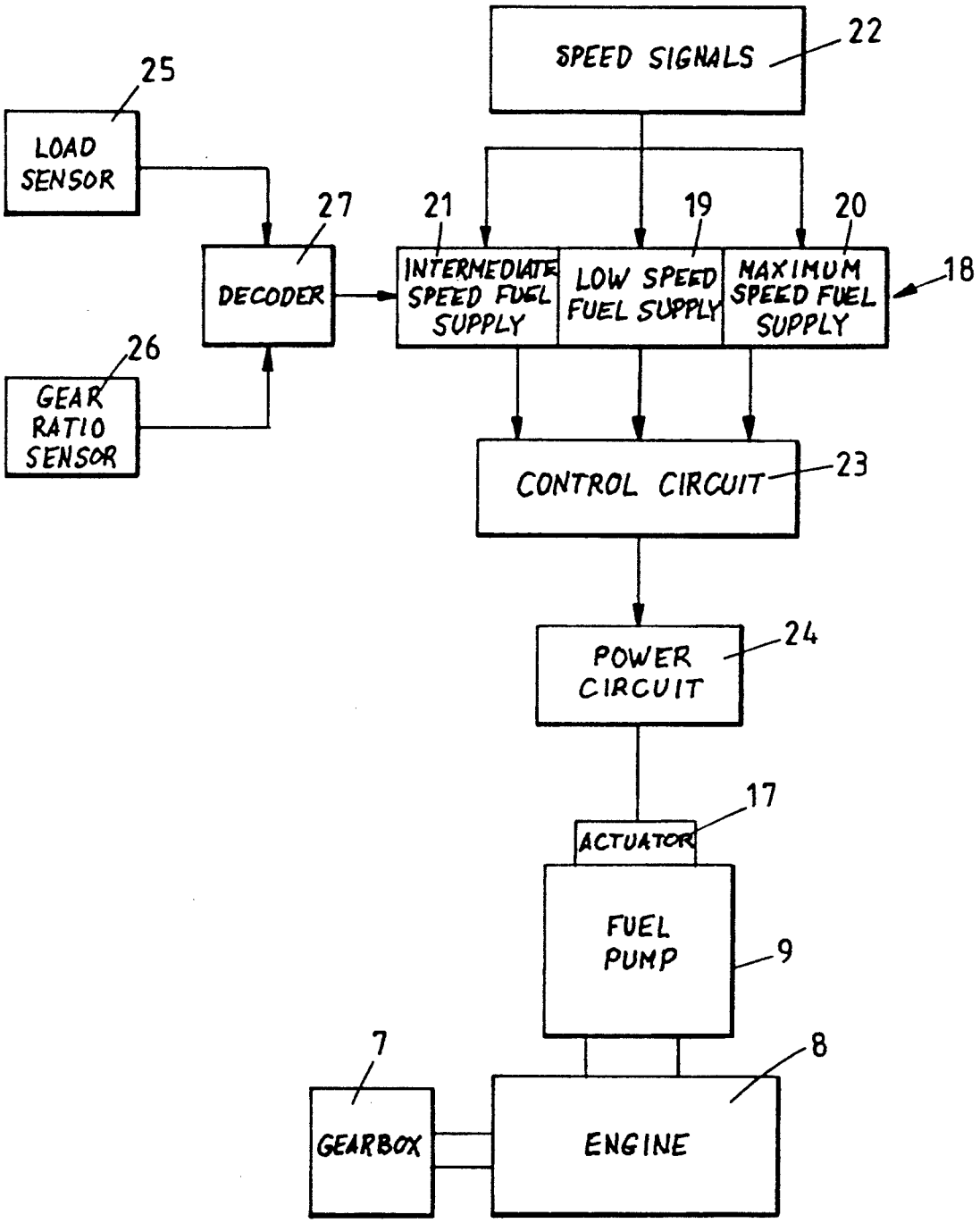
FIG. 3 shows a block diagram of the governor system in accordance with the invention.

FIG. 3 shows the layout of the governor system and its connection to a fuel control actuator 17 associated with a fuel pump 9 supplying fuel to an engine 8. The engine is connected through a multi-ratio gearbox 7 to the powered road wheels of the vehicle. The governor generally indicated at 18 includes a first section 19 which controls the supply of fuel to the engine 9 below the normal idling speed. Section 20 controls the supply of fuel as the engine speed approaches its maximum speed and section 21 determines the supply of fuel to the engine in the intermediate speed range. Each section is supplied with signals corresponding to the actual engine speed and the demanded engine speed, these signals being provided by circuit means 22. The outputs of the portions 19, 20 and 21 of the governor system pass to a control circuit 23 which combines the outputs and controls the operation of a power circuit 24 the output of which is connected to the actuator 17.

Besides the actual and demanded speeds, the portion 21 also receives signals from sensors 25, 26, sensor 25 being arranged to provide a signal indicative of the loaded state of the vehicle and sensor 26 being arranged to provide an indication of the selected gear ratio of the box 7. The outputs of the sensors 25 and 26 are passed to a decoder 27 which supplies a signal to the portion 21 of the governor to determine the slope of the lines 15A and 16A, it being appreciated that these two lines are merely two examples of a large number of lines which can be constructed and lie between the lines 12 and 13.

We claim:

1. A governor system for the fuel pump of a cargo transport vehicle internal combustion engine which is coupled to a multi ratio gear box, the governor system including a governor having an all-speed characteristic characterized by first means directly responsive to the weight of the vehicle below its full cargo loaded weight and second means responsive to the transmission ratio of the gear box said first and second means acting to limit the change in fuel supplied to the engine in the intermediate speed range in response to a demanded engine speed change, thereby limiting the change in engine torque resulting from said demanded engine speed change.

* * * * *